US011234535B2

(12) United States Patent
Rosskelly

(10) Patent No.: US 11,234,535 B2
(45) Date of Patent: Feb. 1, 2022

(54) CRIB BED WITH DETACHABLE SIDE WALL

(71) Applicant: Cam Cam Copenhagen A/S, Copenhagen N (DK)

(72) Inventor: Drew Rosskelly, Copenhagen K (DK)

(73) Assignee: CAM CAM COPENHAGEN A/S, Copenhagen N (DK)

( * ) Notice: Subject to any disclaimer, the term of this patent is extended or adjusted under 35 U.S.C. 154(b) by 0 days.

(21) Appl. No.: 16/981,404

(22) PCT Filed: Mar. 15, 2019

(86) PCT No.: PCT/EP2019/056589
§ 371 (c)(1),
(2) Date: Sep. 16, 2020

(87) PCT Pub. No.: WO2019/175410
PCT Pub. Date: Sep. 19, 2019

(65) Prior Publication Data

US 2021/0007506 A1 Jan. 14, 2021

(30) Foreign Application Priority Data

Mar. 16, 2018 (DK) ..... PA201800120

(51) Int. Cl.
*A47D 7/02* (2006.01)
*A47D 7/01* (2006.01)
*A47D 13/06* (2006.01)

(52) U.S. Cl.
CPC ..... *A47D 7/02* (2013.01); *A47D 13/066* (2013.01); *A47D 7/01* (2013.01); *A47D 13/06* (2013.01)

(58) Field of Classification Search
CPC ... A47D 7/02; A47D 7/01; A47D 9/00; A47D 13/06; A47D 13/065; A47D 13/066;
(Continued)

(56) References Cited

U.S. PATENT DOCUMENTS 1,475,537 A 11/1923 Bradley
4,530,528 A * 7/1985 Shamie ..... A47D 7/02 292/60

(Continued)

FOREIGN PATENT DOCUMENTS

CN 204192130 3/2015
WO 2019/175410 9/2019

OTHER PUBLICATIONS

European Patent Office, International Search Report in International Application No. PCT/EP2019/056589 (dated Apr. 12, 2019) (5 pages).

(Continued)

*Primary Examiner* — Robert G Santos
(74) *Attorney, Agent, or Firm* — Neal, Gerber & Eisenberg LLP; Thomas E. Williams

(57) ABSTRACT

The crib bed (1) has a crib sidewall (5) secured to the crib bed leg construction (7) by means of a latching system (6). A latching bar (13) is spring-loaded by means of a latch bar spring (14) for engagement of the latching pin (16) with a stationary guide member (19). The latching pin (16) is retractable into the latching bar (13) against the load of a spring (17) arranged in the latching bar by displacement of the latching pin along a sloped surface (22) of the stationary guide member (19). The latching pin (16) is secured to the latching bar (13) with a linkage pin (15) extending through a slot (18) of the latching pin and extending through a hole in the latching bar. The linkage pin (15) is guided in a guide rail (12) in the latch housing (11) for retraction of the secured latching pin.

6 Claims, 6 Drawing Sheets

(58) Field of Classification Search
CPC .. A61G 7/0507; A61G 7/0508; A61G 7/0509; A47C 21/08
USPC ..... 5/100, 93.1, 424, 425, 428, 430
See application file for complete search history.

(56) References Cited

U.S. PATENT DOCUMENTS 4,706,312 A * 11/1987 Shamie ..... A47D 7/03 5/100
5,068,932 A * 12/1991 Chang ..... A47D 7/02 5/100
5,146,632 A 9/1992 Li
5,165,124 A * 11/1992 Li ..... A47D 7/02 292/DIG. 4
5,432,962 A * 7/1995 Huang ..... A47D 7/02 292/124
8,572,775 B1 * 11/2013 Biter ..... A47D 7/02 5/100
8,646,127 B1 2/2014 Lytle
8,745,781 B1 * 6/2014 Biter ..... A47D 7/02 5/100
8,806,687 B1 * 8/2014 Houry ..... A47D 7/02 5/663
9,380,884 B2 * 7/2016 Lawlor ..... A47D 13/065
2014/0115779 A1 * 5/2014 Lawlor ..... A47D 7/02 5/99.1
2021/0007506 A1 * 1/2021 Rosskelly ..... A47D 7/02

OTHER PUBLICATIONS

European Patent Office, Written Opinion of the International Search Authority in International Application No. PCT/EP2019/056589 (dated Apr. 12, 2019) (5 pages).

* cited by examiner

CRIB BED WITH DETACHABLE SIDE WALL

The invention relates to a latch and supporting assembly for the attaching and detaching of the crib bed side to allow easy access to a withheld infant or for the means of easy access for hygienic cleaning of the bedding materials within.

The invention is for a general type crib bed having spaced vertical bars connected to a crib wall support construction, wherein the crib bed side wall and crib bed leg includes a latch and supporting assembly where the stationary latch receiving piece is connected to the crib bed leg corner at each of the two crib bed legs where the crib bed side is attached. The stationary latch-receiving piece is formed to create a flush surface between the formed stationary latch piece and the wooden crib leg recess.

The stationary latch piece is formed to guide the latch catching piece into the locked position, induced by the gravity actuated automatic spring-loaded lock under the weight of the detachable crib bedside. The stationary latch piece is formed with a sloped surface to create a transitional resistance from unlocked to precise locked position.

A multiple action trigger lever is actuated to detach the crib bedside wall with a childproof operation. This multiple action operation involves first pulling on the latch trigger followed by a rotational movement of the trigger latch followed by a vertical lifting action of the trigger and crib bedside wall construction.

The known types of latches, fixtures or supporting means for attaching and detaching crib bed side walls often require excess operation to attach and detach the crib bed side wall such as screws or manually operated latches to secure the crib bed side wall to the crib bed construction.

U.S. Pat. No. 5,146,632 discloses a lifting gate controlling device for controlling the front lifting gate of a baby's crib, including a mounting bar fastened in either front corner post of a baby's crib, a slide movably mounted on the mounting bar, a lock bolt fastened in the slide and controlled by a compression spring, a movable socket and a retaining block to releasably engage into a slot on the mounting bar, so that when the top rail of the front lifting gate is moved upwardly, this causes the lock bolt to disengage from the slot on the mounting bar, thus permitting the front lifting gate to be moved from an upper limit position to a lower limit position. A slopping track is made on the mounting bar to guide the lock bolt into the slot, when the front lifting gate is moved upwards from its lower limit position, so that the front lifting gate can be locked in its upper limit position.

It is therefore the highly desirable object of this invention to provide a latch and supporting assembly for attaching the side of the crib bed which does not require manual latching operations to attach the crib bed side wall and a child proof but easy operation to detach the crib bed side wall from the crib bed construction.

The invention will now be explained in more detail below by means of examples of embodiments with reference to the very schematic drawing, in which FIG. 1 is a perspective view of the subject matter of the present invention shown as crib bed construction having a sidewall attached by means of the latch and supporting assembly of this in position thereon;

Figure 1:
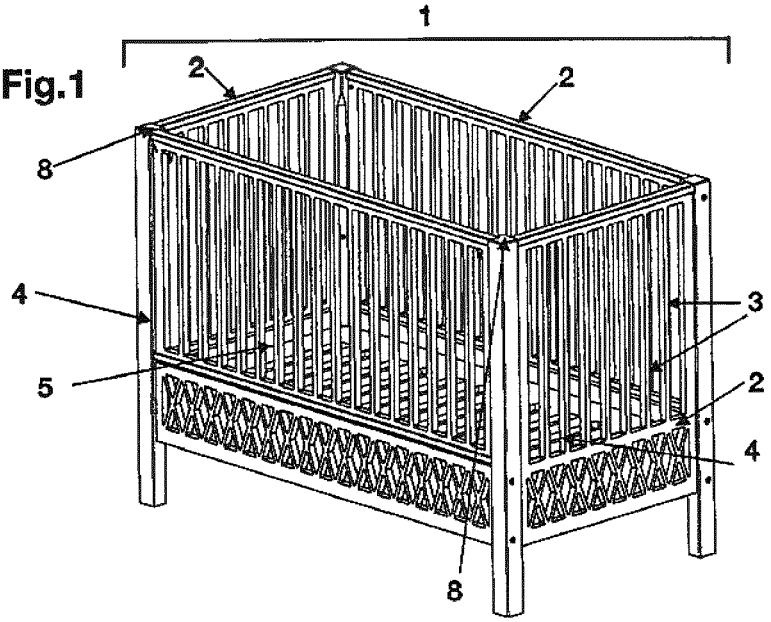
Figure 2:
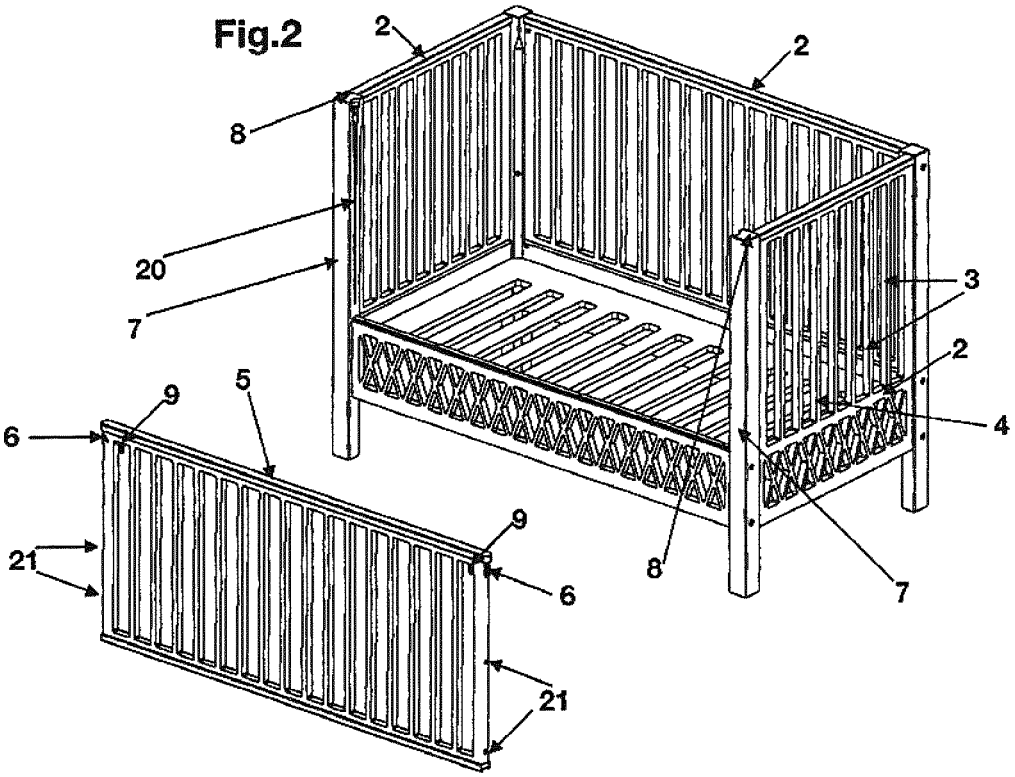
FIG. 2 is an exploded view of the crib bed construction and crib bedside wall is in detaching position.
Figure 3:
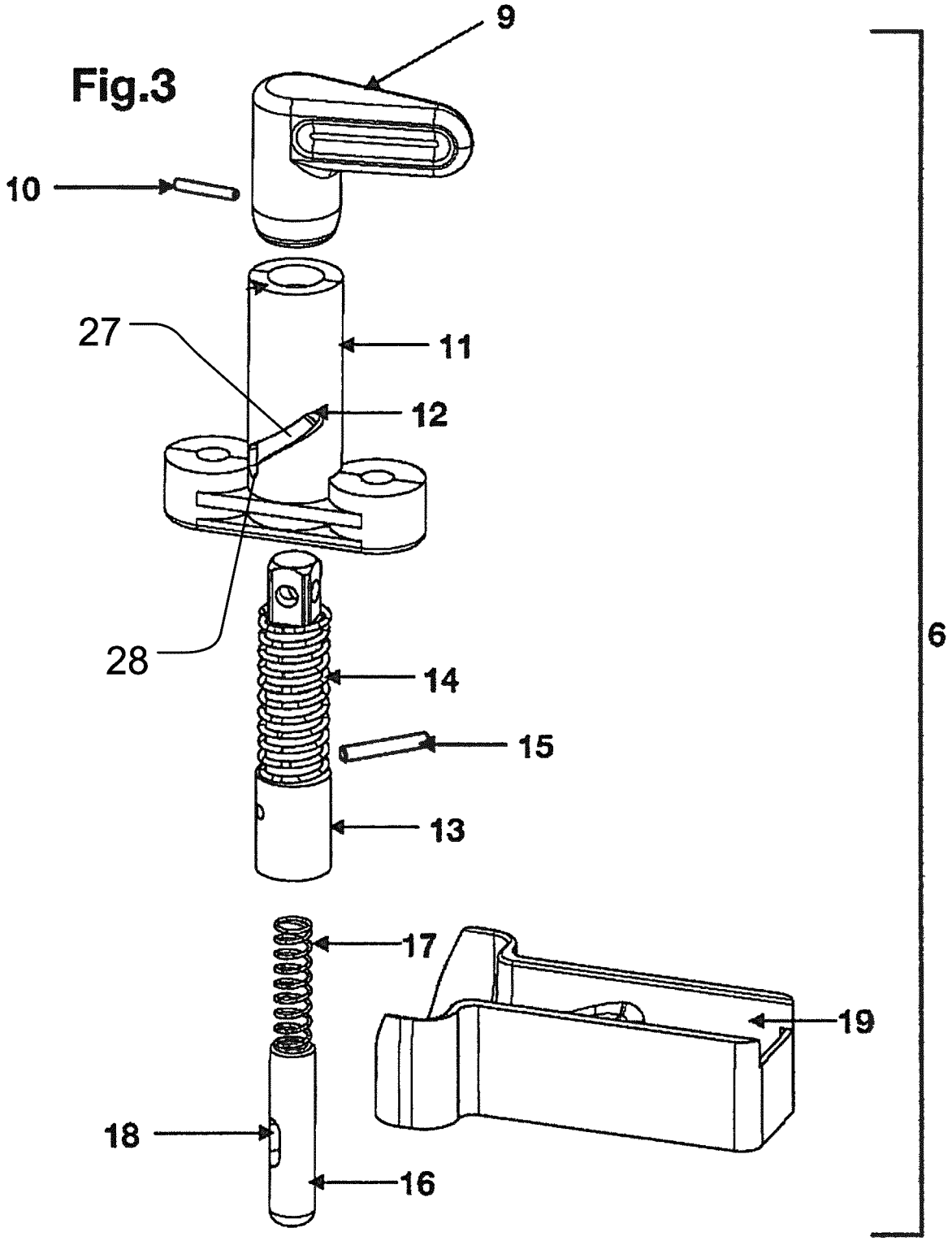
FIG. 3 is an exploded view of the automated locking and multi action release latching system with accompanying stationary latching geometry in accordance to the present invention and removed from the crib bedside wall construction.
Figure 4:
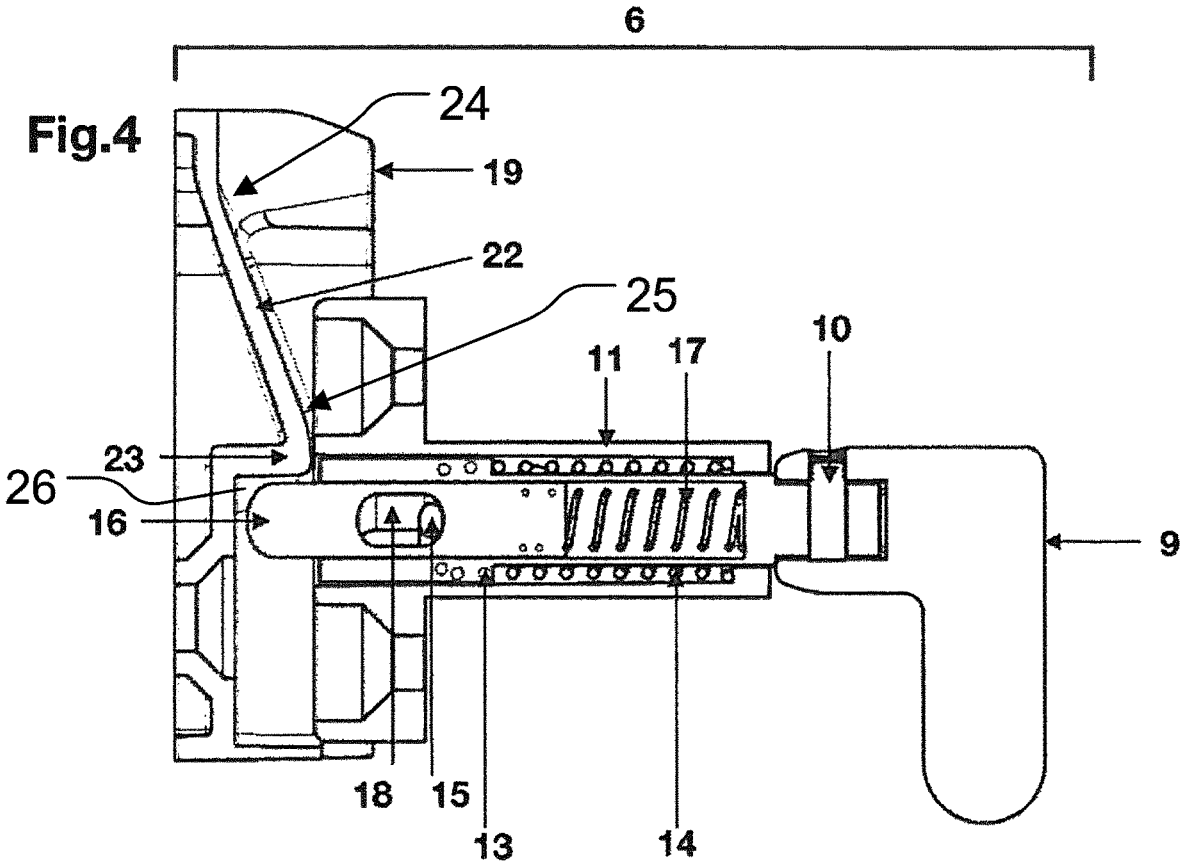
FIG. 4 is a section view of the automated locking and multi action release latching system with accompanying stationary latching geometry.
Figure 5:
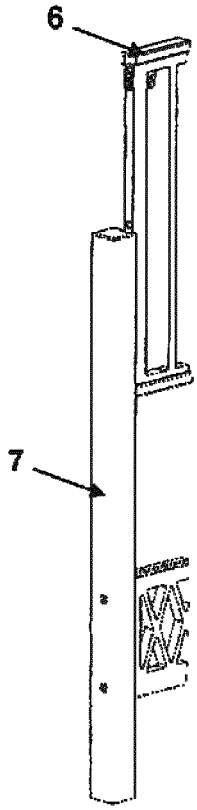
FIG. 5 is a perspective partial view of the crib bed leg and crib bed side wall latching assembly in position with guide pins located and bed side detachable and ready for automatic locking.
Figure 6:
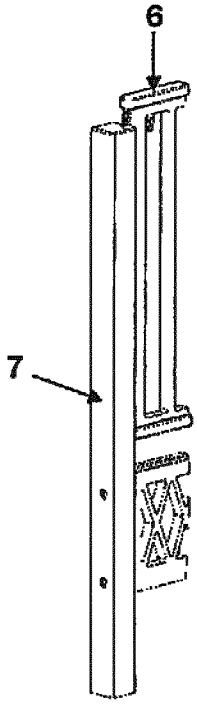
FIG. 6 is a perspective partial view of the crib bed leg and crib bed side wall latching assembly in position with guide pins located wherein latch housing is centered in crib bed construction by means of the latch housing geometry and receiving leg latching geometry and bed side detachable and ready for automatic locking.
Figure 7:
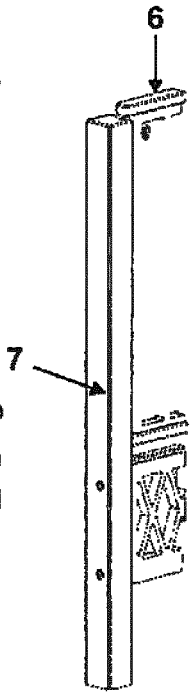
FIG. 7 is a perspective partial view of the crib bed leg and crib bed side wall latching assembly in position with locking pin moving up ramp approaching side wall attachment location.
Figure 8:
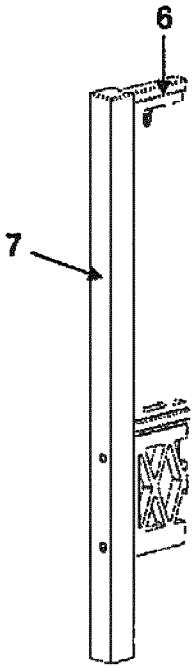
FIG. 8 is a perspective partial view of the crib bed leg and crib bed side wall attached wherein the crib ben sidewall is latched and locked to the crib bed leg assembly.
Figure 9:
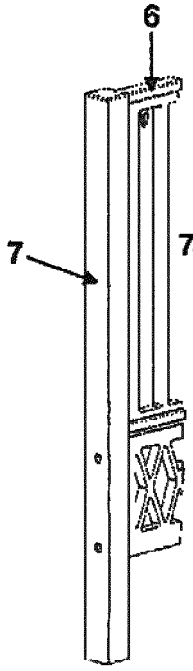
FIG. 9 is a perspective partial view of the crib bed leg and crib bedside wall wherein the multi action latch trigger is pulled first horizontally and co-axially to the of latch release pin. Crib bedside wall is still attached to crib bed leg construction.
Figure 10:
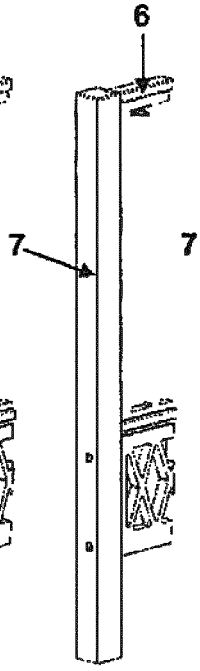
FIG. 10 is a perspective partial view of the crib bed leg and crib bed side wall wherein the multi action latch trigger is pulled horizontally and co-axially to the of latch release pin and additionally rotated co-axially to the latch locking pin into the outmost location to the point where the latch locking pin is released from the leg locking geometry.
Figure 11:
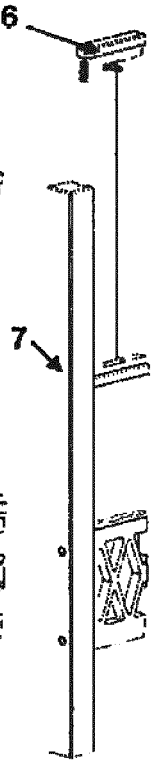
FIG. 11 is a perspective partial view of the crib bed leg and crib bed side wall wherein the multi action latch trigger is pulled and additionally rotated to it outmost location to the point where the locking pin is released from the leg locking geometry wherein the crib bed side wall is lifted and detachable from the crib bed geometry.
Figure 12:
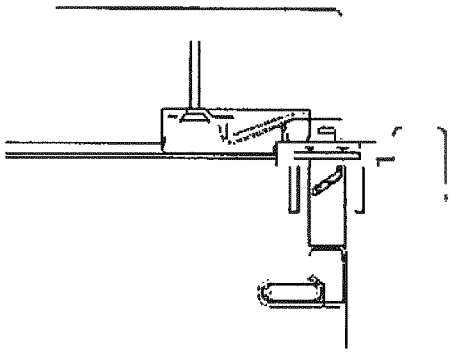
FIG. 12 is a partial section view of the crib bed leg and crib bed side wall latching assembly in position with guide pins located and bed side detachable and ready for automatic locking.
Figure 13:
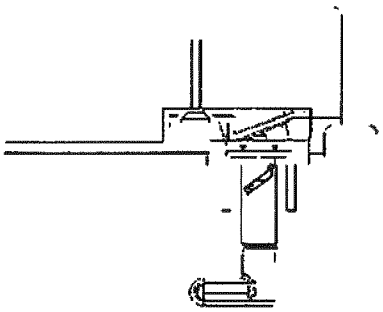
FIG. 13 is a partial section view of the crib bed leg and crib bed side wall latching assembly in position with locking pin moving up ramp approaching side wall attachment location.
Figure 14:
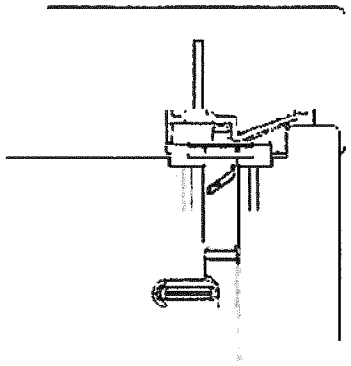
FIG. 14 is a partial section view of the crib bed leg and crib bedside wall attached wherein the crib bed sidewall is latched and locked to the crib bed leg assembly.
Figure 15:
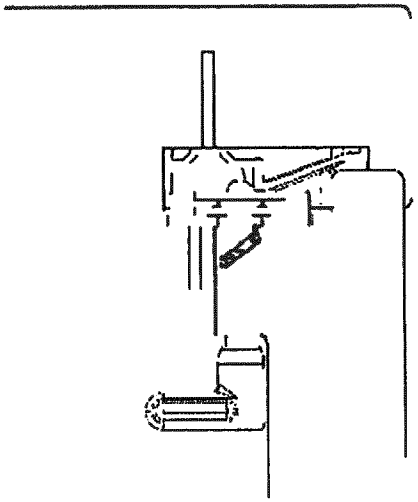
Figure 16:
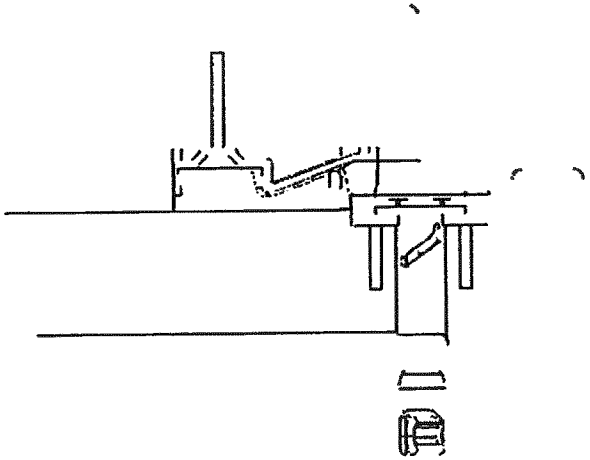

FIG. 15 is a partial section view of the crib bed leg and crib bedside wall wherein the multi action latch trigger is pulled first horizontally and co-axially to the of latch release pin. Crib bedside wall is still attached to crib bed leg construction; and FIG. 16 is a partial section view of the crib bed leg and crib bed side wall wherein the multi action latch trigger is pulled horizontally and co-axially to the of latch release pin and additionally rotated to it outmost location to the point where the locking pin is released from the leg locking geometry and the crib bed side wall is lifted and detachable from the crib bed geometry.

Referring to the figures there is disclosed generally a crib bed 1 having restraining crib bedside wall 2 as of a general type crib bed having spaced vertical bars 3 connected to a crib bed wall support construction 4.

The portion of the crib bed 1 which is utilized for this invention is a detachable restraining crib sidewall 5 with childproof multi action sidewall latching system 6 that is connected to the crib bedside wall 2 and crib bed leg construction 7.

The latching system 6 is attached and integrated into the detachable crib bedside wall 5 at each top corner 8.

The latching system 6 includes a trigger lever 9, trigger lever linkage pin 10, latch housing 11 with novel integrated guide rail 12, latching bar 13, latch bar spring 14, linkage pin 15, latching pin 16, which is spring loaded for automatic latching with the use of a spring 17 and slot 18 horizontal and perpendicular to the latching plane of the latch housing 11.

The latching system 6 insures automatic attachment of the crib sidewall 5 to the crib bed construction 4 without activation of the trigger lever 9 and instead by means of lowering crib sidewall 5 vertically into the stationary guide member 19 within the crib bed leg construction 7. The latching system 6 secures at least one of the crib bedside wall 5 to the constructions to the crib wall support construction 4 utilizing the spring loaded latching pin 16. The latching system 6 requires multiple actions to detach the crib bed side wall 5 from the remaining crib bed construction 4 in a child safe operation.

Attachment of the crib bedside wall 5 occurs when the crib bedside wall 5 is inserted into the leg guide rails 20 with the assistance of centering pins 21 and secondary centered the crib bed assembly 1 with the stationary guide member 19 and the latch housing 11. On lowering the crib bedside wall 5 a spring loaded latching pin 16 is retracted into the latching bar 13 by means of a sloped surface 22. When the crib bed sidewall 5 and latching system 6 reaches the lowest position in the stationary guide member 19, the latching pin 16 is extended horizontally and co-axially to the latching pin 16 utilizing the spring 17.

It is important to child proof and safe operation of the crib bed that the crib bedside wall cannot be detached partially of fully by a child. To insure this the detachable crib bed sidewall 5 utilizes latching system 6 on both sides of the crib bedside wall 5. The latching system 6 is placed at a distance further then the reach of a child or infants arm span. The latching system 6 utilizes a novel ramp in the form of guide rail 12 that guides first a pulling motion of the trigger lever 9 both horizontally and co-axially to the latching pin 16. Through the use of a trigger lever linkage pin 10 connected to the latching bar 13 and assembled linkage pin 15 the latching pin 16 is pulled a partially toward the unlocking position 23. It is novel to the invention of the trigger lever 9 is release at this position or any position the trigger lever 9 and latching pin 16 with connecter assembly will return to the unlocking position 23 utilizing the co-axial latch bar spring 14.

To fully unlock the crib bedside wall 5 a first horizontal and co-axial motion to the latching pin 16 and afterwards a secondary rotary motion of the trigger lever 9 must be applied. The multiple combined actions of horizontal and later rotary motion of the trigger lever 9 is considered childproof and is guided by use of the guide rail 12 within the latching housing 11.

In short, the crib bed 1 is of the general type with at least one detachable crib sidewall 5 that is secured to the crib bed leg construction 7 utilizing a spring loaded latching pin 16 with latching pin including slot 18 perpendicular to the axis of the latching pin 16 where slot 18 is secured to latching bar 13 with a linkage pin 15 through said slot 18 and linkage pin 15 extends through a hole in latching bar 13 where the linkage pin 15 and attached trigger lever 9 is guided by guide rail 12 in latch housing 11 to retract the secured latching pin 16 and latching bar 13 in a motion first which is co-axial and horizontal to the latching pin 16 and afterwards a second motion which is rotational and co-axial to the latching pin 16 and said assembly is spring loaded as to always return to the latch lock position with release of the trigger lever 9.

The crib bed 1 is of the general type with at least one detachable crib sidewall 5 being secured to the crib bed leg construction 7 by means of a latching system 6 including a latch housing 11 on the detachable crib sidewall 5 and a stationary guide member 19 within the crib bed leg construction 7, the latching system 6 being spring loaded as to always return to a latch lock position with release of trigger lever 9, a latching bar 13 being arranged rotatably and displaceably in the latch housing 11 in order to displace a latching pin 16 adapted to engage the stationary guide member 19, the latching bar 13 being provided with the trigger lever 9 at a first end for rotating and displacing the latching bar 13 and the latching pin 16, the latching bar 13 being provided with the latching pin 16 at a second end, and the latching bar 13 being spring-loaded in the latch housing 11 by means of a latch bar spring 14 arranged around the latch bar 13 for engagement of the latching pin 16 with the stationary guide member 19. The crib bed 1 is characterised in that, for attachment of the detachable crib sidewall 5 to the crib bed leg construction 7, the latching pin 16 is retractable into the latching bar 13 against the load of a spring 17 arranged in the latching bar 13 by displacement of the latching pin 16 along a sloped surface 22 of the stationary guide member 19, in that the latching pin 16 includes a slot 18 perpendicular to the axis of the latching pin 16, in that the latching pin 16 is secured to the latching bar 13 with a linkage pin 15 extending through the slot 18 of the latching pin 16 and extending through a hole in the latching bar 13, and in that, for detachment of the detachable crib sidewall 5 from the crib bed leg construction 7, the linkage pin 15 and thereby the attached trigger lever 9 is guided in a guide rail 12 in the latch housing 11 for retraction of the secured latching pin 16 and latching bar 13 in a first motion which is horizontal and co-axial to the latching pin 16 and afterwards in a second motion which is rotational and co-axial to the latching pin 16.

In an embodiment, the guide rail 12 has the form of a groove in the latch housing 11.

In an embodiment, the groove has a helical section and a straight section extending in an axial direction of the latching pin 16.

In an embodiment, an extension of the slot 18 of the latching pin 16 in an axial direction of the latching pin 16 defines the possible retraction of the latching pin 16 into the latching bar 13 so that, independently of the position of the latching bar 13 in the latch housing 11, a tip of the latching pin 16 may pass along the entire sloped surface 22 of the stationary guide member 19 in the retracted postion of the latching pin 16 into the latching bar 13.

In an embodiment, in the attached position of the crib sidewall 5 to the crib bed leg construction 7 by means of the latching system 6, the latching pin 16 is in its extended position in the latching bar 13 and a tip of the latching pin 16 is located in a recess 26 of the stationary guide member 19, wherein the sloped surface 22 of the stationary guide member 19 has a first end 24 located at a level of the tip of the latching pin 16 in the extended position of the latching pin 16 and has a second end 25 located at a level of the tip of the latching pin 16 in the retracted position of the latching pin 16 in the latching bar 13, and wherein the recess 26 of the stationary guide member 19 is located next to the second end of the sloped surface 22 of the stationary guide member 19.

In an embodiment, the detachable crib sidewall 5 is adapted to be attached to the crib bed leg construction 7 by insertion of the crib bedside wall 5 into the leg guide rails 20 with the assistance of centering pins 21 of the crib sidewall 5 and with the assistance of the stationary guide member 19 and the latch housing 11.

It is to be understood that the invention is not to be limited to the specific constructions and arrangements shown and described, as it will be understood those skilled in the art, changes can be made without parting from the principles of the invention.

LIST OF REFERENCE NUMBERS

1 crib bed
2 restraining crib bedside wall
3 spaced vertical bars
4 crib bed wall support construction
5 detachable crib sidewall
6 latching system (or latch assembly)
7 crib bed leg construction
8 top corner
9 trigger lever (or latch trigger)
10 trigger lever linkage pin
11 latch housing
12 guide rail (or guide rail system, ramp detail, guide rail geometry)
13 latching bar
14 latch bar spring
15 linkage pin (or locking pin, latching pin linkage)
16 latching pin
17 spring
18 slot (or slot geometry)
19 stationary guide member (or guide geometry)
20 leg guide rail
21 centering pin
22 sloped surface
23 unlocking position
24 first end of sloped surface
25 second end of sloped surface
26 recess of stationary guide member
27 helical section of groove forming guide rail
28 straight section of groove forming guide rail

The invention claimed is:

1. A crib bed (1) with at least one detachable crib sidewall (5) being secured to a crib bed leg construction (7) by means of a latching system (6) including a latch housing (11) on the detachable crib sidewall (5) and a stationary guide member (19) within the crib bed leg construction (7), the latching system (6) being spring loaded as to always return to a latch lock position with release of a trigger lever (9), a latching bar (13) being arranged rotatably and displaceably in the latch housing (11) in order to displace a latching pin (16) adapted to engage the stationary guide member (19), the latching bar (13) being provided with the trigger lever (9) at a first end for rotating and displacing the latching bar (13) and the latching pin (16), the latching bar (13) being provided with the latching pin (16) at a second end, and the latching bar (13) being spring-loaded in the latch housing (11) by means of a latch bar spring (14) arranged around the latching bar (13) for engagement of the latching pin (16) with the stationary guide member (19), characterised in that, for attachment of the detachable crib sidewall (5) to the crib bed leg construction (7), the latching pin (16) is retractable into the latching bar (13) against the load of a spring (17) arranged in the latching bar (13) by displacement of the latching pin (16) along a sloped surface (22) of the stationary guide member (19), in that the latching pin (16) includes a slot (18) perpendicular to an axis of the latching pin (16), in that the latching pin (16) is secured to the latching bar (13) with a linkage pin (15) extending through the slot (18) of the latching pin (16) and extending through a hole in the latching bar (13), and in that, for detachment of the detachable crib sidewall (5) from the crib bed leg construction (7), the linkage pin (15) and thereby the attached trigger lever (9) is guided in a guide rail (12) in the latch housing (11) for retraction of the secured latching pin (16) and latching bar (13) in a first motion which is horizontal and co-axial to the latching pin (16) and afterwards in a second motion which is rotational and co-axial to the latching pin (16).

2. A crib bed (1) according to claim 1, wherein the guide rail (12) has the form of a groove in the latch housing (11).

3. A crib bed (1) according to claim 2, wherein the groove has a helical section and a straight section extending in an axial direction of the latching pin (16).

4. A crib bed (1) according to claim 1, wherein an extension of the slot (18) of the latching pin (16) in an axial direction of the latching pin (16) defines the possible retraction of the latching pin (16) into the latching bar (13) so that, independently of a position of the latching bar (13) in the latch housing (11), a tip of the latching pin (16) may pass along the entire sloped surface (22) of the stationary guide member (19) in a retracted position of the latching pin (16) into the latching bar (13).

5. A crib bed (1) according to claim 1, wherein, in an attached position of the crib sidewall (5) to the crib bed leg construction (7) by means of the latching system (6), the latching pin (16) is in an extended position in the latching bar (13) and a tip of the latching pin (16) is located in a recess (26) of the stationary guide member (19), wherein the sloped surface (22) of the stationary guide member (19) has a first end (24) located at a level of the tip of the latching pin (16) in the extended position of the latching pin (16) and has a second end (25) located at a level of the tip of the latching pin (16) in a retracted position of the latching pin (16) in the latching bar (13), and wherein the recess (26) of the stationary guide member (19) is located next to the second end of the sloped surface (22) of the stationary guide member (19).

6. A crib bed (1) according to claim 1, wherein the detachable crib sidewall (5) is adapted to be attached to the crib bed leg construction (7) by insertion of the crib bedside wall (5) into leg guide rails (20) in the crib bed leg construction with the assistance of centering pins (21) of the crib sidewall (5) and with the assistance of the stationary guide member (19) and the latch housing (11).

* * * * *